US006382202B2

(12) United States Patent
Chau-Ngoc et al.

(10) Patent No.: US 6,382,202 B2
(45) Date of Patent: May 7, 2002

(54) DRILL BIT

(75) Inventors: Diep Chau-Ngoc, München; Rolf Spangenberg, Gauting, both of (DE)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 09/778,440

(22) Filed: Feb. 7, 2001

(30) Foreign Application Priority Data

Feb. 7, 2000 (DE) ..... 100 05 365

(51) Int. Cl.[7] ..... B28D 1/02
(52) U.S. Cl. ..... 125/20; 451/541
(58) Field of Search ..... 451/541, 542; 125/40, 20; 408/68, 204

(56) References Cited

U.S. PATENT DOCUMENTS 2,923,180 A * 2/1960 Dunn et al. ..... 408/68
3,778,179 A * 12/1973 Rivas ..... 125/20
3,978,733 A * 9/1976 Avot ..... 408/68
4,131,384 A * 12/1978 Hougen ..... 408/68
4,193,721 A * 3/1980 Hougen ..... 408/68
4,696,308 A * 9/1987 Meller et al. ..... 408/204
4,785,826 A * 11/1988 Ward ..... 408/204
5,316,416 A * 5/1994 Kim ..... 408/204

FOREIGN PATENT DOCUMENTS

EP 0776721 4/1992
EP 0480263 6/1997

* cited by examiner

*Primary Examiner*—Derris H. Banks
(74) *Attorney, Agent, or Firm*—Sidley Austin Brown & Wood, LLP

(57) ABSTRACT

A drill bit for producing circular-cylindrical recesses or boreholes is formed of a drilling cylinder (1) having cutting elements (3) at the leading end in the drilling direction. A detachable core sleeve (2) is arranged in the interior of the drilling cylinder (1). The cutting elements (3) extend radially inwardly at least for the wall thickness (a) of the core sleeve (2). The core sleeve (2) serves to receive a core formed of removed masonry and is intended to facilitate removal of the core from the drill bit. The manageability of the drill bit is substantially improved in this way.

10 Claims, 1 Drawing Sheet

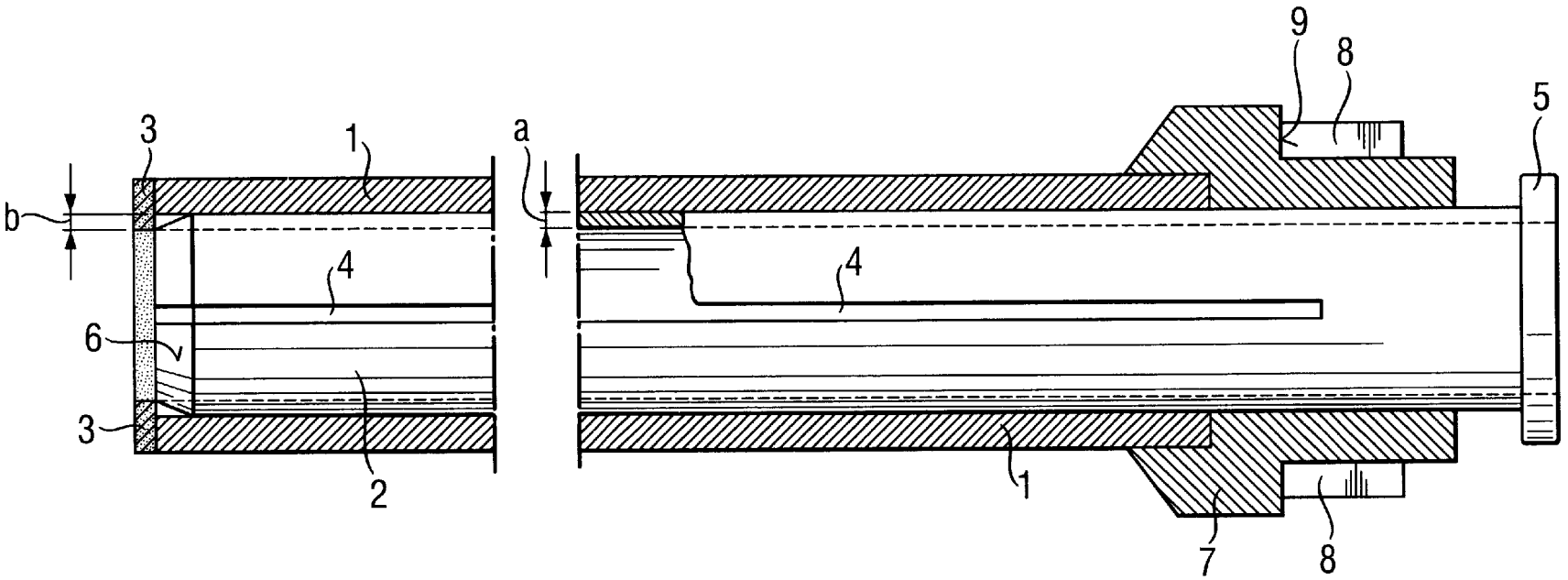
5
8
9
8
7
1
4
a
1
4
2
3
6
3
b

DRILL BIT

BACKGROUND OF THE INVENTION

The invention is directed to a drill bit for cutting circular-cylindrical recesses or boreholes and includes a drilling cylinder having, at its end leading in the drilling direction, cutting elements which extend radially inwardly of the inner diameter of the drilling cylinder.

Drill bits of the type mentioned above are used to cut large boreholes and openings, particularly in masonry, concrete or rock. When removing the drill bit from the bore-holes or openings, an inner core initially remains in the drilling cylinder of the drill bit and subsequently must be broken out by a suitable tool.

A drill bit of the type described above is disclosed in EP 0776721 A1. It has a drilling cylinder with a drill extending axially in its interior. Cutting elements are arranged at the leading end face of the drilling cylinder and extend partially radially into the interior of the drilling cylinder. Due to the fact that the cutting elements are constructed in this way, the core remaining in the drilling cylinder has a smaller diameter than the inner diameter of the drilling cylinder. For the most part, this prevents the core from jamming in the drilling cylinder. In addition, the drill arranged in the drilling cylinder prevents the core from tilting.

It is disadvantageous in this known drill bit that the drillings resulting from the drilling operation or breaking of the core contained in the drilling cylinder can cause the core to jam in the drill bit. In such a case, the core must be broken out of the drilling cylinder, for example, by means of suitable tools. In so doing, there is a risk that the drill bit will be damaged and will no longer be usable. Moreover, the drilling operation takes more time, which has economical drawbacks.

SUMMARY OF THE INVENTION

It is a primary object of the present invention to provide a drill bit in which the core can be easily removed from the drilling cylinder. In addition, the drill bit has a simple and economical construction.

According to the invention, this object is met in that the interior of the drilling cylinder is open at the trailing end in the drilling direction and has an at least constant inner diameter or contour, and a detachable core sleeve is arranged in the interior of the drilling cylinder, the wall thickness of this core sleeve corresponding at most to the radially inward dimension of the cutting element from the inner surface of the drilling cylinder.

Due to the fact that the core sleeve is arranged in the drilling cylinder so as to be detachable, it is possible to remove the core sleeve, including the core contained therein, from the drill bit without difficulty after each drilling operation. Since the drilling cylinder has an interior open trailing end in the drilling direction and has an at least constant inner diameter or contour, the core sleeve can be pulled out of the drilling cylinder in the direction opposite to the drilling direction. By an at least constant inner diameter or contour is meant that the inner diameter does not decrease toward the open end, but rather is uniform or increases, so that it is possible to remove the core sleeve from the drilling cylinder in the direction opposite to the drilling direction. In order to receive the core in the core sleeve, the diameter of the core must not be greater than that of the core sleeve. This is ensured in that the wall thickness of the core sleeve corresponds at most to the radial inward projection of the portion of the cutting element extending radially inwardly of the drilling cylinder. In rare exceptional cases where the core cannot be removed from the core sleeve, the financial loss occasioned by the loss of the core sleeve is minor compared with the loss of the entire drill bit.

Preferably, the core sleeve has at least one axially extending slit extending along at least part of its length. In this way, the core sleeve which is removed from the drilling cylinder can be more easily separated from the core remaining therein and it is impossible for the core to jam in the core sleeve.

The axially extending slit is advantageously open at the leading end in the drilling direction, so that the core can be removed from the core sleeve in an optimal manner. Moreover, the structure of the core remains completely intact, for example, for purposes of analyzing the substrate.

A sufficient stability of the core sleeve is preferably achieved in that the outer diameter of the core sleeve is constructed in such a way that the core sleeve completely contacts the inner wall of the drilling cylinder and has a smaller diameter in the inserted state than when not inserted. In this way, it is possible to guide the core sleeve in the drilling cylinder and accordingly to pull the core sleeve out of the drilling cylinder without difficulty at the same time. In addition, the core sleeve is biased or pretensioned when inserted in the drilling cylinder, resulting in a frictional engagement between the drilling cylinder and the core sleeve. This prevents unwanted displacement of the core sleeve relative to the drilling cylinder, particularly during the drilling operation.

A gripping part is advisably arranged at the trailing end of the core sleeve located opposite to the drilling direction so as to make it possible for the user to remove the pretensioned core sleeve from the drilling cylinder in a simple manner.

In order to ensure a secure insertion of the core sleeve into the drilling cylinder, preferably the core sleeve has, at its leading end, an outer diameter region which tapers or narrows in the drilling direction. Especially in view of the fact that the inserted core sleeve is pretensioned, a secure guiding is particularly important when inserting into the drilling cylinder and facilitates handling of the drill bit.

The drill bit is manufactured in an economical manner in that the core sleeve has a wall thickness corresponding to 0.01 to 0.3 times the wall thickness of the drilling cylinder. Further, such dimensioning of the core sleeve has a positive effect in the manageability of the drill bit.

The core sleeve can be inserted into the drilling cylinder without difficulty due to the fact that the axially extending slit preferably has a width corresponding to 0.001 to 0.01 times the outer diameter of the core sleeve. Since the core sleeve is pretensioned in the inserted state, at least the width of the axially extending slit must correspond roughly to the difference in the circumference of the core sleeve in the inserted state and in the relaxed state.

Advisably, the core sleeve is made of spring steel to ensure optimal holding of the core sleeve in the drilling cylinder. At the same time, the necessary stability of the core sleeve is achieved through the use of spring steel. The high elasticity limit of spring steel means simpler handling and longer useful life in removing the core from the core sleeve.

The drawing is an axially extending view, partly in section and partly broken away of a drill bit embodying the present invention.

DETAILED DESCRIPTION OF THE INVENTION

The drawing shows, in partial axial section, a drill bit according to the invention which has an axially extending drilling cylinder 1 and an axially extending core sleeve 2 fitted axially in the drilling cylinder 1. Further, at its leading end in the drilling direction, the drilling cylinder 1 has cutting elements 3 extending radially inwardly into the interior of the drilling cylinder 1. A cylindrically shaped adapter 7 is arranged at the trailing end of the drill bit and is connected with the drilling cylinder 1, for example, by welding, soldering or gluing.

The adapter 7 is used for connection to a handheld machine tool, not shown. The torque is transmitted from the handheld machine tool, not shown, to the drill bit by means of a plurality of drivers 8 arranged at the outer circumference of the adapter 7. Facing the opposite to the drilling direction, the adapter 7 has a stop shoulder 9 adjacent to the drivers 8 which is constructed as a flange.

The core sleeve 2 inserted into the drilling cylinder 1 has a cylindrical inner diameter or contour and is made of spring steel with a wall thickness a such that the extent b of the inward projection of the cutting elements 3 into the drilling cylinder 1 corresponds to this wall thickness a. An axially extending slit 4 extends from the leading end in the drilling direction over a greater part of the length of the core sleeve 2. The core sleeve 2 has an annular flange-like gripping part 5 at its trailing end opposite the drilling direction and has, at its leading end, an outer diameter region 6 which narrows in the drilling direction and forms an insertion bevel.

What is claimed is:

1. Drill bit for cutting circular-cylindrical recesses or boreholes comprising an axially extending drilling cylinder (1) having a first end leading in the drilling direction, a second end trailing in the drilling direction, an axially extending inner surface and an axially extending outer surface, at least one cutting element (3) located at said first end of said drilling cylinder and projecting at least radially inwardly from said inner surface, said drilling cylinder being open at said first and second ends thereof, said inner surface having a constant inside diameter between said first and second ends of said drilling cylinder, an axially extending detachable core sleeve (2) located within said drilling cylinder having a first end leading in the drilling direction and having a wall thickness transversely of an axial direction corresponding at most to the radially inward projection of said cutting element (3).

2. Drill bit, as set forth in claim 1, wherein said core sleeve (2) has at least one axially extending slit (4) extending at least for a part of the axial length thereof.

3. Drill bit, as set forth in claim 2, wherein said axially extending slit (4) is open at said first end of said core sleeve (2).

4. Drill bit, as set forth in one of claims 1 to 3, wherein said core sleeve (2) has an outside diameter relative to the diameter of said inner surface of said drilling cylinder so that the outside diameter of said core sleeve when inserted into said drilling cylinder is in complete surface contact with said inner surface of said drilling cylinder, and after insertion into said drilling cylinder has a smaller outside diameter than prior to such insertion.

5. Drill bit, as set forth in one of claim 1 to 3, wherein said core sleeve (2) has an axially extending gripping part (5) at a second end thereof trailing in the drilling direction.

6. Drill bit, as set forth in claim 5, wherein said gripping part (5) at least in part in the axial direction extends radially outwardly from the outside surface of said drilling cylinder (1).

7. Drill bit, as set forth in claims 1 to 3, wherein said core sleeve (2) at the first end thereof has an axially extending outer diameter region (6) tapering inwardly from the outside diameter of said core sleeve to said first end thereof.

8. Drill bit, as set forth in one of claims 1 to 3, wherein said core sleeve (2) has a wall thickness in the range of 0.01 to 0.03 times the wall thickness of said drilling cylinder (1).

9. Drill bit, as set forth in one of claims 2 to 3, wherein said axially extending slit (4) has a width in the circumferential direction of said core sleeve in the range of 0.001 to 0.01 times the outer diameter of said core sleeve (2).

10. Drill bit, as set forth in one of claims 1 to 3, wherein said core sleeve (2) is formed of spring steel.

* * * * *